US009547255B2

(12) United States Patent
Miyauchi et al.

(10) Patent No.: US 9,547,255 B2
(45) Date of Patent: Jan. 17, 2017

(54) PROCESS CARTRIDGE DETACHABLY ATTACHED TO A MAIN BODY OF AN ELECTROPHOTOGRAPHIC APPARATUS

(71) Applicant: CANON KABUSHIKI KAISHA, Tokyo (JP)

(72) Inventors: Yuto Miyauchi, Mishima (JP); Minoru Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/979,357

(22) Filed: Dec. 22, 2015

(65) Prior Publication Data

US 2016/0187810 A1 Jun. 30, 2016

(30) Foreign Application Priority Data

Dec. 25, 2014 (JP) ..... 2014-262500

(51) Int. Cl.
*G03G 15/08* (2006.01)

(52) U.S. Cl.
CPC ..... *G03G 15/0812* (2013.01); *G03G 15/0808* (2013.01); *G03G 15/0818* (2013.01)

(58) Field of Classification Search
CPC ..... G03G 21/1857; G03G 21/186; G03G 15/0812
USPC ..... 399/66, 284, 274
See application file for complete search history.

(56) References Cited

U.S. PATENT DOCUMENTS

| | | | | |
|---|---|---|---|---|
| 2004/0223789 | A1 | 11/2004 | Inami | |
| 2010/0054804 | A1 | 3/2010 | Uneme | |
| 2010/0232830 | A1* | 9/2010 | Wada | C09B 67/0016 399/111 |
| 2014/0051019 | A1* | 2/2014 | Sekiguchi | G03G 9/08764 430/105 |
| 2014/0205338 | A1 | 7/2014 | Gondoh | |
| 2015/0003862 | A1 | 1/2015 | Nakamura | |

FOREIGN PATENT DOCUMENTS

| | | | |
|---|---|---|---|
| EP | 2762501 | A1 | 8/2014 |
| JP | 08-227212 | A | 9/1996 |
| JP | 2007-033538 | A | 2/2007 |
| JP | 2012037644 | A | 2/2012 |

* cited by examiner

*Primary Examiner* — Quana M Grainger
(74) *Attorney, Agent, or Firm* — Canon U.S.A. Inc., IP Division

(57) ABSTRACT

There is provided a developing unit capable of suppressing a memory to leave on a developing roller even when held under high-temperature and high-humidity conditions for a long period of time before the start of use.
The developing unit has a developing roller and a toner regulating member in contact with each other with resin particles therebetween. The resin particles have a toluene absorbency of 20 g or more and 50 g or less per 40 g of the resin particles and a Martens hardness of 1.0 N/mm$^2$ or more and 50.0 N/mm$^2$ or less.

9 Claims, 4 Drawing Sheets

PROCESS CARTRIDGE DETACHABLY ATTACHED TO A MAIN BODY OF AN ELECTROPHOTOGRAPHIC APPARATUS

BACKGROUND OF THE INVENTION

Field of the Invention

The present invention relates to a developing unit, a process cartridge, and an electrophotographic apparatus.

Description of the Related Art

The operation of electrophotographic apparatuses, such as copiers, printers, and facsimile receivers, starts with uniformly charging a rotating image carrier using a charger and irradiating the image carrier with laser light to produce an electrostatic latent image. A developing unit then feeds toner to the electrostatic latent image and develops it into a toner image. The toner image is then transferred from the image carrier to a transfer substrate (recording substrate) and fixed on the transfer substrate through heating or similar, yielding an image-bearing transfer substrate. The image carrier from which the toner image has been transferred has its surface electrically neutralized and cleaned of any residual toner to get on standby for a new image formation process.

The developing unit includes a developing chamber and a toner container which contains the toner. The developing chamber is provided with some components such as a developing roller and a toner feeder that applies the toner to the surface of the developing roller. Inside the developing chamber there is also a toner regulating member, a component configured to shape the toner applied by the toner feeder to the surface of the developing roller into a thin and more uniform layer. Thus, a thin layer of the toner is sent out of the developing unit as the developing roller rotates. The thin layer of the toner adheres to the electrostatic latent image carried on the image carrier rotating in front of an exposed section of the developing roller. As a result, the electrostatic latent image is visualized into a toner image on the image carrier.

The developing unit is so designed that the toner stays in the toner container until the activation of the unit and enters the developing chamber only after the unit starts working. Before the developing unit starts to operate, therefore, the developing roller and the toner regulating member are in direct contact with each other.

Japanese Patent Laid-Open No. 8 (1996)-227212 mentions some problems caused by direct contact between a developing sleeve and a toner feed roller in a developing unit standing by for use, such as damage to the toner feed roller. The publication discloses that such problems can be solved by the use of a toner feed roller having cells in its outermost surface with a powder having a specific sort of chargeability at least on the surface of the toner feeder.

Furthermore, Japanese Patent Laid-Open No. 2007-33538 discloses that applying a powder having a glass transition temperature of 80° C. or more to the surface of the toner feeder also solves such problems.

An aspect of the invention is directed to providing a developing unit capable of suppressing a memory to leave on a developing roller, the memory being a cause of a banding in an electrophotographic image, even when held under high-temperature and high-humidity conditions for a long period of time before the start of use. The definitions of the terms "memory" and "banding" and the expression "a memory is left" are provided later.

Certain aspects of the invention are also directed to providing a process cartridge and an electrophotographic apparatus both capable of stable output of high-quality electrophotographic images.

SUMMARY OF THE INVENTION

An aspect of the invention provides a developing unit. The developing unit includes a developing chamber and a toner container. The developing chamber is provided with a developing roller and a toner regulating member. The developing roller is configured to hold toner on a surface thereof and carry the toner to a developing region, and the toner regulating member to regulate an amount of the toner held on the surface of the developing roller. The toner container contains the toner. The developing roller and the toner regulating member are in contact with each other at a point of contact, with resin particles therebetween. The resin particles have a toluene absorbency of 20 g or more and 50 g or less per 40 g of the resin particles and a Martens hardness of 1.0 $N/mm^2$ or more and 50.0 $N/mm^2$ or less.

Another aspect of the invention provides a process cartridge configured to be detachably attached to a main body of an electrophotographic apparatus. The process cartridge includes an image carrier and a developing unit. The image carrier is configured to carry an electrostatic latent image, and the developing unit to develop the electrostatic latent image with toner and to form a toner image. The developing unit is an above-descried developing unit.

Yet another aspect of the invention provides an electrophotographic apparatus. The electrophotographic apparatus includes an image carrier, a charging unit, an exposure unit, a developing unit, a transfer unit and a fixing unit. The image carrier is configured to carry an electrostatic latent image, the charging unit to charge the image carrier, the exposure unit to produce an electrostatic latent image on the charged image carrier, the developing unit to develop the electrostatic latent image with toner and to form a toner image, and the transfer unit to transfer the toner image to a transfer substrate. The developing unit is an above-descried developing unit.

Further features of the present invention will become apparent from the following description of exemplary embodiments with reference to the attached drawings.

DESCRIPTION OF THE EMBODIMENTS

Figure 1:
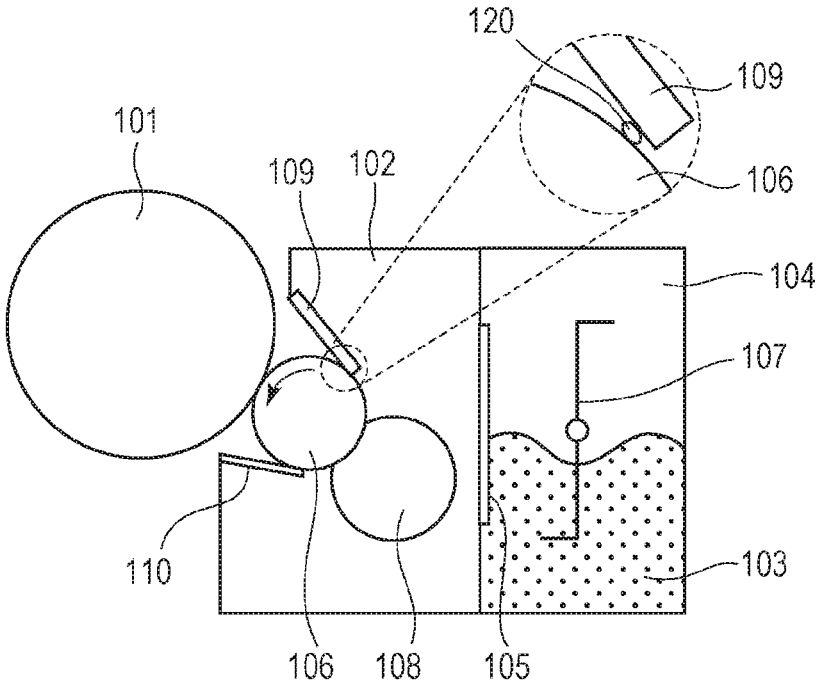
FIG. 1 is a schematic cross-sectional diagram illustrating an example of a developing unit according to an aspect of the invention.

Studies by the inventors on the developing unit according to Japanese Patent Laid-Open No. 2007-33538, however, revealed that situations such as leaving the developing unit under high-temperature and high-humidity conditions for a long period of time before the start of use can cause a streak-shaped form of unevenness, the streaks corresponding to the area of the surface of the developing roller where the roller comes into contact with the toner regulating member, to appear on electrophotographic images. Such streaks of unevenness on electrophotographic images may be referred to as "banding" hereinafter. Banding tends to be particularly significant in halftone images. This seems to be caused by some change occurring in the area of the surface of the developing roller where the roller comes into contact with the toner regulating member.

A change that occurs on the surface of a developing roller and is of a kind that affects the quality of electrophotographic images may be referred to as "a memory" herein. Likewise, a situation where "a memory" occurs may be described as "a memory is left." The inventors have assumed that the "memory" is attributable to uneven distribution of potential on the surface of the developing roller caused by a change in the surface electrical resistance of the roller.

The inventors studied the developing unit according to Japanese Patent Laid-Open No. 2007-33538 in detail, with regard to a memory that occurs when leaving the unit under high-temperature and high-humidity conditions for a long period of time. The results of the studies suggested two major causes of the memory.

That is, when the particles disposed at the point of contact between the developing roller and the toner regulating member are capable of absorbing much toluene, or have a high toluene absorbency, low-molecular-weight components of the developing roller are likely to be pulled up to the surface of the roller by these particles. Any low-molecular-weight component on the surface of the developing roller affects the electrical resistance of the area where it exists, causing uneven distribution of potential between the areas highly conductive to electrical current and the areas that are not (a memory).

Furthermore, the particles disposed at the point of contact between the developing roller and the toner regulating member put physical stress on the developing roller when having a high degree of hardness, helping low-molecular-weight components of the developing roller in exuding to the surface of the roller.

To solve these problems, the inventors conducted extensive research on what particles should be interposed between the developing roller and the toner regulating member.

The finding is that the use of a particular kind of resin particles as the particles interposed between the developing roller and the toner regulating member reduces the occurrence of banding. To be more specific, the inventors used resin particles having a toluene absorbency of 20 g or more and 50 g or less per 40 g of the resin particles and a Martens hardness of 1.0 $N/mm^2$ or more and 50.0 $N/mm^2$ or less. Resin particles having such a toluene absorbency and a Martens hardness are neither likely to adsorb low-molecular-weight components of the developing roller nor likely to put physical stress on the developing roller. These features, in the opinion of the inventors, prevented uneven distribution of resistance on the surface of the developing roller and reduced the occurrence of banding.

The inventors also found that the toluene absorbency of resin particles correlates with the amount of low-molecular-weight components of the developing roller the polymer particles adsorb on the surface of the roller. The toluene absorbency of resin particles is thus used as a measure of the amount of low-molecular-weight components of the developing roller the polymer particles adsorb on the surface of the roller.

Resin Particles

The developing unit needs to include resin particles having a toluene absorbency of 20 g or more and 50 g or less per 40 g of the resin particles and a Martens hardness of 1.0 $N/mm^2$ or more and 50.0 $N/mm^2$ or less between the developing roller and the toner regulating member.

Resin particles having a toluene absorbency of more than 50 g per 40 g thereof will adsorb low-molecular-weight components of the developing roller. The resulting uneven distribution of electrical resistance between the areas on the surface of the developing roller where any low-molecular-weight component exists and the areas where no such component exists will make banding more likely to occur. Resin particles having a toluene absorbency of less than 20 g per 40 g thereof will be effective in preventing banding in halftone images, but at the same time will cause great physical stress on the developing roller because resin particles generally become harder with decreasing toluene absorbency.

Resin particles having a Martens hardness of more than 50.0 $N/mm^2$ will cause great physical stress on the developing roller and therefore can cause banding. Resin particles having a Martens hardness of less than 1.0 $N/mm^2$ will be effective in preventing banding in halftone images, but high tack of the material from which they are made will cause some problems that affect the quality of images, such as firm adhesion of the particles to the nearby components.

An example of base materials for the resin particles that meet these characteristics requirements (Martens hardness and toluene absorbency) is urethane polymers.

The resin particles may have an average circularity of 0.960 or more. Resin particles having an average circularity of 0.960 or more can be easily forced into rolling motions, and this will help distribute the resin particles evenly between the developing roller and the toner regulating member. Such particles should therefore be particularly effective in preventing banding.

Furthermore, the resin particles may have a weight-average particle diameter of 1 μm or more and 50 μm or less. Ensuring that the weight-average particle diameter of the resin particles is in this range will lead to more effective prevention of banding.

Production of the Resin Particles

The resin particles can be produced through suspension polymerization. To be more specific, a mixture of a medium (mainly water) and a monomer insoluble in the medium is vigorously stirred to disperse into droplets 0.01 to 1 mm in size in the medium, and then a polymerization initiator is added to this monomer dispersion to polymerize the monomer into resin particles.

In this embodiment, the toluene absorbency of the resin particles is determined by the crosslinking density and distance between crosslinks of the material of which the particles are made, and the Martens hardness is determined by the molecular structure and crosslinking density of the material of which the particles are made material that meets certain characteristics requirements is therefore selected. When urethane-based resin particles are used, their toluene absorbency and Martens hardness can be controlled by adjusting the ratio by weight of polyol to isocyanate components, OH/NCO %, and by adding mono-ol. The toluene absorbency and Martens hardness of the resin particles can also be controlled through surface treatment, such as silane coupling, treatment with oil, and fluorination.

Toluene Absorbency of the Resin Particles

The toluene absorbency of the resin particles was measured as follows.

One gram (1 g) of the resin particles was prepared and put into a beaker. Toluene (trade name, Toluene Special Grade (purity 99.5%); Kishida Chemical) was added dropwise to the beaker containing the resin particles, and the total consumption (g) of toluene was recorded at the time when the resin particles no longer absorbed toluene. The obtained total consumption of toluene was multiplied by 40 to give the toluene absorbency of the resin particles per 40 g of the particles (i.e., the toluene absorbency according to this embodiment of resin particles). The unit of measurement for the toluene absorbency according to this embodiment of resin particles is the gram (g).

Martens Hardness of the Resin Particles

The Martens hardness of the resin particles was measured using a nanoindentation tester (trade name, PICODENTOR® HM500; Fischer instruments). The indenter was a 136° pyramidal diamond indenter (a Vickers indenter).

The measurement included indenting a sample with the above indenter under a predetermined load (hereinafter referred to as the indentation) and releasing the sample from the load (hereinafter referred to as the unloading).

Analyzing the obtained load-displacement curve using the dedicated measurement software "WIN-HCU" (trade name) yielded the Martens hardness ($N/mm^2$).

A more detailed description of the procedure is as follows. The resin particles were applied to a glass slide (AS ONE Corporation) using a cotton swab, and any excess of the resin particles was blown away with air. The remaining particles were subjected to measurement. Resin particles having a size close to the weight-average particle diameter (D4, described in more detail below) of the particles were selected for measurement.

Due to the 1-μm resolution of the measurement stage, it is difficult to push the center of a small particle on the order of 10 μm with the tip of the indenter, and when trying to indent such a particle, the tip of the indenter may hit the surface of the particle not vertically but at some angle, and the measurement may become inaccurate. Thus, after indenting the particle with the indenter, the stage was returned to the microscope side, and the position of the particle was confirmed so that the position of the particle still remained in its initial position.

If the displacement of the particle was less than 1 μm, the tip of the indenter hit the center of the particle and the measured data were determined to be valid. If the displacement of the particle was 1 μm or more or the particle was not found on the glass slide (caught on the indenter), the measured data were determined to be invalid. After each measurement, the indenter was adjusted into positional alignment and cleaned with ethanol.

The measurement parameters were as follows: indentation, a maximum indentation load of 0.1 mN and a duration of indentation of 20 s; unloading, the same parameters as in loading. With these parameters, valid data on the Martens hardness of the resin particles were collected (N=20). The average Martens hardness of 18 particles excluding two with the largest and smallest measurements was taken as the Martens hardness of the resin particles.

Measurement of the Average Circularity of the Resin Particles

The average circularity of the resin particles was measured using "FPIA-3000" flow particle image analyzer (Sysmex) with the measurement and analytical parameters for calibration.

A more detailed description is as follows. Approximately 20 ml of ion-exchanged water free of solids and other impurities was put into a glass vessel. To this vessel, approximately 0.2 ml of a dilution of a dispersant (trade name, Contaminon N; Wako Pure Chemical Industries; a 10% by mass aqueous solution of a pH-7 neutral detergent for precision measuring instruments composed of a nonionic surfactant, an anionic surfactant, and organic builders) in ion-exchanged water (approximately 1:3, m/m) was added.

Then approximately 0.02 g of the resin particles as a measurement sample was added and dispersed for 2 minutes using an ultrasonic dispersing machine, yielding a dispersion for measurement. The temperature of the dispersion was kept to be 10° C. or more and 4.0° C. or less throughout this process, and cooling was performed if needed for this to be ensured. The ultrasonic dispersing machine was a benchtop ultrasonic washer/disperser with an oscillation frequency of 50 kHz and an electrical output of 150 W (e.g., "VS-150" (Kabushiki Kaisha VELVO-CLEAR)), and this was used with a predetermined amount of ion-exchanged water and approximately 2 ml of Contaminon N in the tank.

The measurement was performed using the aforementioned flow particle image analyzer with its standard objective lens (10×) and "PSE-900A" particle sheath. (Sysmex) as sheath liquid. The dispersion prepared using the above-described procedure was introduced into the flow particle image analyzer, and 3000 resin particles were measured under the total count settings in the HPF (high power field) measuring mode. Then specifying the particle diameters to be analyzed and analyzing the particles with a binarization threshold of 85% gave the proportion by number (%) and average circularity of those particles that fell in the specified diameter range. In calculating the average circularity of the resin particles, the range of particle diameters to be analyzed was set to be equivalent circular diameters of 1.98 μm or more and 39.96 μm or less.

Before the start of measurement, and optionally every 2 hours afterwards, automatic focus adjustment was performed using standard latex particles (trade name, RESEARCH AND TEST PARTICLES Latex Microsphere Suspensions 5200a; Duke Scientific) diluted in ion-exchanged water.

The flow particle image analyzer was calibrated and granted a certificate of calibration by Sysmex before use. The measurement and analytical parameters were the same as those at the issuance of the certificate of calibration except that the particle diameters to be analyzed were limited to equivalent circular diameters of 1.98 μm or more and 39.96 μm or less.

Measurement of the Weight-Average Particle Diameter (D4) of the Resin Particles

Coulter Multisizer III particle size analyzer (a trade name of Beckman Coulter) was used for measurement. An approximately 1% aqueous solution of sodium chloride was prepared using first-grade sodium chloride. Approximately 5 mg of the resin particles to be measured (sample) was suspended in approximately 100 ml of this electrolyte solution with approximately 0.5 ml of alkylbenzene sulfonate as a dispersant. The sample suspended in the electrolyte solution was dispersed for approximately 1 minute using an ultrasonic dispersing machine. The volume and number distributions of the sample were then determined from the volume and number of the sample particles measured using the aforementioned analyzer with a 100-μm aperture. The obtained distributions were used to calculate the weight-average particle diameter (D4).

Developing Unit

The following describes an exemplary embodiment of a developing unit according to an aspect of the invention in detail with reference to some drawings. The size, material, shape, relative positions, and other details of structural components described in this embodiment are not intended to limit the scope of any aspect of the invention thereto unless the description clearly states so. FIG. 1 illustrates an example of a cross-sectional view of a developing unit according to this embodiment.

As illustrated in FIG. 1, this developing unit includes a developing chamber 102 which has an opening in a portion facing an image-carrying unit 101. On the back side of this developing chamber 102, there is a toner container 104 communicating with the developing chamber 102 and containing toner 103. The passage through which the developing chamber 102 communicates with the toner container 104 is partitioned with a removable seal 105 configured to prevent the toner 103 in the toner container 104 from flowing into the developing chamber 102. This seal 105 is removed from the passage at the time when the developing unit starts to operate.

This structure prevents the toner 103 from unexpectedly flowing out of the developing unit because of vibrations, such as vibrations associated with the transportation of the developing unit before the start of use, thereby protecting the user, the developing unit, and the main body of the image formation apparatus used therewith from being stained with the toner.

Figure 4:
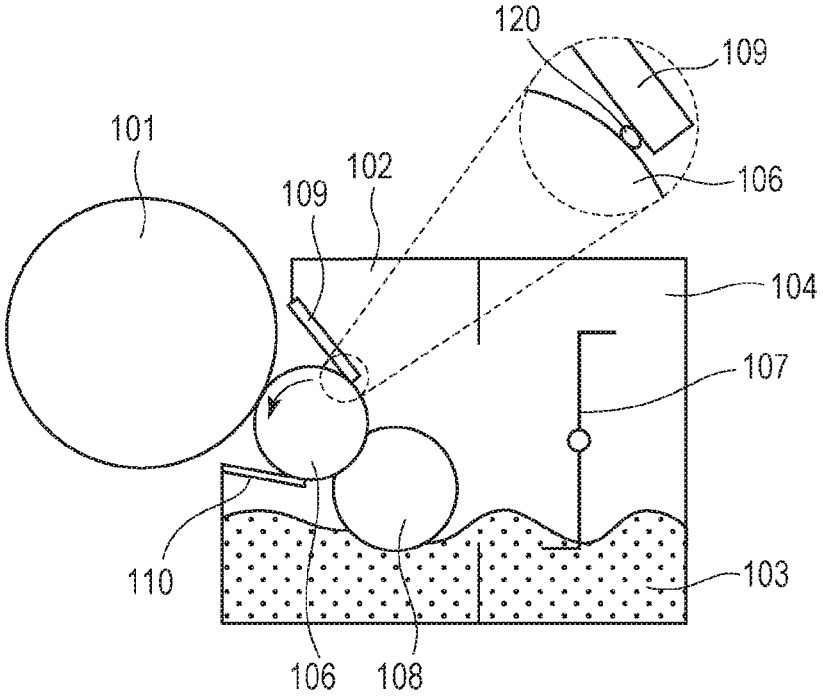
FIG. 4 is a schematic cross-sectional diagram illustrating an example of a developing unit according to an aspect of the invention.

As illustrated in FIG. 4, however, the seal that partitions the passage connecting the developing chamber 102 and the toner container 104 is not essential for the developing unit according to this embodiment.

In the developing chamber 102, there is a rotatably installed developing roller 106 partially exposed to the outside. The developing roller 106 faces the image-carrying unit 101 and presses and touches it to make a predetermined inroad amount.

The developing chamber 102 also contains a toner feeder 108, a component configured to receive the toner a delivery element 107 sends out of the toner container 104 and to feed it to the developing roller 106. Upstream in the direction of the rotation of the developing roller 106, there is a toner regulating member 109, a component configured to regulate the amount of the toner 103 retained on the developing roller 106, in contact with the surface of the developing roller 106. This toner regulating member 109 is in attachment with the developing chamber 102. In this embodiment, the developing roller 106 and the toner regulating member 109 are coated with a predetermined kind of resin particles 120 at least where they are in contact with each other, to reduce banding in halftone images.

Downstream in the direction of the rotation of the developing roller 106, there is an anti-blowout sheet 110, a sheet configured to prevent sudden escapes of the toner from the lower section of the developing chamber 102.

Development starts with removing the seal 105 from the developing unit to combine the toner container 104 and the developing chamber 102 into a single space, and the toner 103 in the toner container 104 is allowed into the developing chamber 102 only after this. The delivery element 107 delivers the toner 103 toward the toner feeder 108 over the partition, and the toner feeder 108 applies the toner 103 to the developing roller 106. The developing roller 106 is rotated in the direction indicated by the arrow in the drawing, and the toner 103 carried on the developing roller 106 is shaped by the toner regulating member 109 into a layer having a predetermined thickness and carried to a developing region, a region facing the image-carrying unit 101.

Examples of methods for placing the resin particles 120 at the point of contact between the developing roller 106 and the toner regulating member 109 include those that involve applying the resin particles as in methods 1 to 3 below. The resin particles can be applied using any method that allows the developing roller and the toner regulating member to be uniformly coated.

1. Applying the resin particles to the entire surface of the developing roller 106, and then installing this developing roller 106 in the developing unit to which the toner regulating member 109 has already been attached.

2. Applying the resin particles to the area of the toner regulating member 109 where it will come into contact with the developing roller 106, and then installing this toner regulating member 109 and the developing roller 106 in the developing unit.

3. Applying the resin particles to the entire surface of the toner feeder 108, and installing the toner feeder 108 in the developing unit provided with the developing roller 106 and the toner regulating member 109, then turning the developing roller 106 and the toner feeder 108 to deliver the resin particles to the point of contact between the developing roller 106 and the toner regulating member 109. Process cartridge and electrophotographic apparatus An electrophotographic apparatus according to an embodiment of the invention has the following structural elements. The developing unit is a developing unit according to the above embodiment of the invention:

An image carrier configured to carry an electrostatic latent image

A charging unit configured to charge the image carrier

An exposure unit configured to produce an electrostatic latent image on the charged image carrier A developing unit configured to develop the electrostatic latent image with toner and to form a toner image A transfer unit configured to transfer the toner image to a transfer substrate A fixing unit configured to fix the toner image transferred to the transfer substrate A process cartridge according to an embodiment of the invention includes an image carrier configured to carry an electrostatic latent image and a developing unit configured to develop the electrostatic latent image with toner and to form a toner image. The process cartridge can be detachably attached to a main body of an electrophotographic apparatus, and the developing unit is a developing unit according to the above embodiment of the invention.

Figure 2:
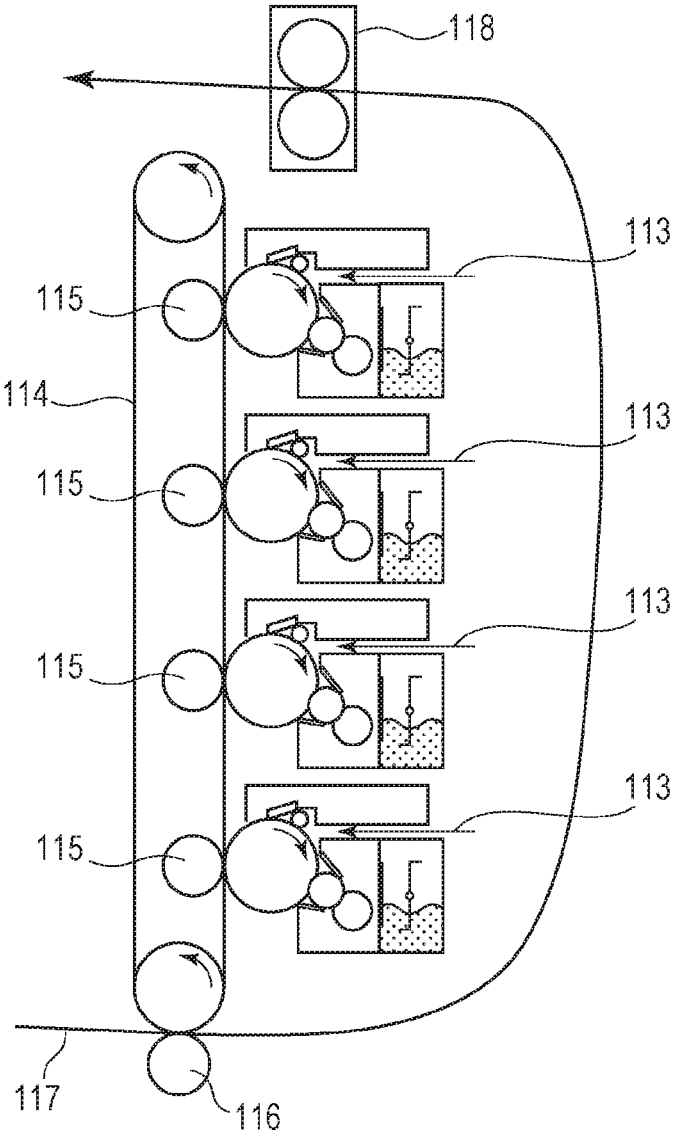
FIG. 2 is a schematic cross-sectional diagram illustrating an example of an electrophotographic apparatus according an aspect of the invention.
Figure 3:
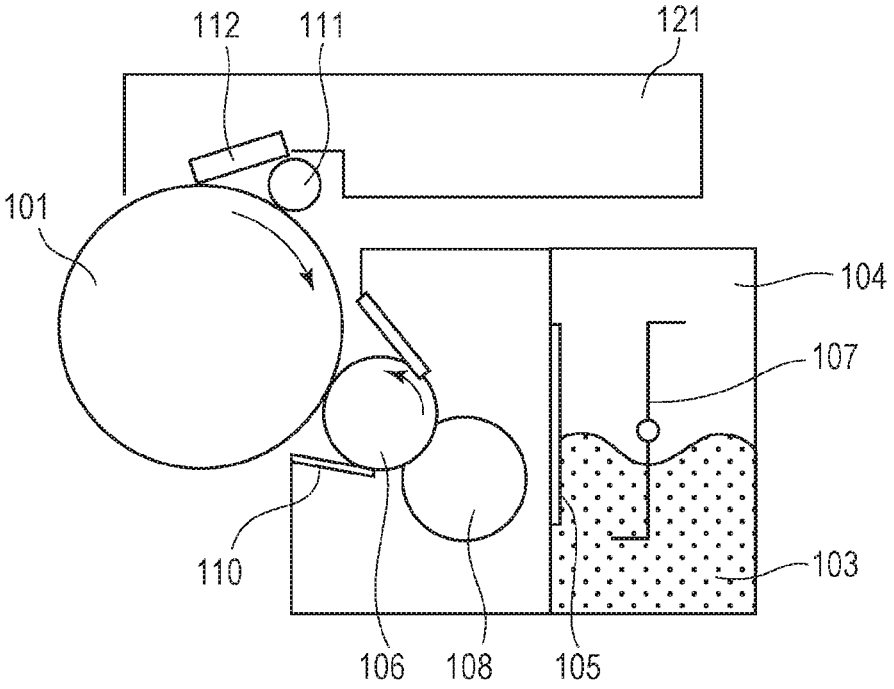
FIG. 3 is a schematic cross-sectional diagram illustrating an example of a process cartridge configured to be attached to an electrophotographic apparatus according to an aspect of the invention.

FIG. 2 is a schematic cross-sectional view of an electrophotographic apparatus according to an embodiment of the invention. FIG. 3 is an enlarged cross-sectional view of a process cartridge configured to be attached to the electrophotographic apparatus illustrated in FIG. 2. The process cartridge incorporates an image-carrying unit 101, a charging unit, a developing unit, and a cleaning unit 121. The image-carrying unit 101 corresponds to the aforementioned image carrier, and the charging unit is provided with a charger 111. The developing unit is provided with a developing roller 106, and the cleaning unit 121 is provided with a cleaner 112. The process cartridge can be detachably attached to the main body of the electrophotographic apparatus illustrated in FIG. 2.

The image-carrying unit 101 is uniformly charged, to a potential of approximately −800 V or more and −400 V or less, by the charger 111 which is connected to a bias power supply (not illustrated). The image-carrying unit 101 is then exposed to light 113 for writing an electrostatic latent image, producing an electrostatic latent image on the surface of the image-carrying unit 101. The light 113 for exposure can be light from an LED, and can also be laser light. The surface potential of the exposed area of the image-carrying unit 101 is approximately −200 V or more and −100 V or less.

Then the developing roller 106, incorporated in the process cartridge configured to be detachably attached to a main body of an electrophotographic apparatus, applies negatively charged toner to the electrostatic latent image (development). This produces a toner image on the image-carrying unit 101, i.e., converts the electrostatic latent image into a visible image. During this process the bias power supply (not illustrated) applies a voltage of approximately −500 V or more and −300 V or less to the developing roller 106. The developing roller 106 is in contact with the image-carrying unit 101, with the nip width being approximately 0.5 mm or more and 3 mm or less.

The toner image developed on the image-carrying unit 101 is then transferred to an intermediate transfer belt 114 (first transfer). There is a first transfer element 115 in contact with the back side of the intermediate transfer belt 114. Applying a voltage of approximately +100 V or more and +1500 V or less to the first transfer element 115 induces the first transfer, i.e., transfer of the negative toner image from the image-carrying unit 101 to the intermediate transfer belt 114. The first transfer element 115 can be in the shape of a roller, and can also be in the shape of a blade.

When the electrophotographic apparatus is a full-color image formation apparatus, it is needed to perform these charging, exposure, development, and first transfer processes for each of four colors: yellow, cyan, magenta, and black. For this purpose, the electrophotographic apparatus illustrated in FIG. 2 includes a total of four process cartridges, each incorporating toner in one of the aforementioned colors, detachably attached to its main body. The charging, exposure, development, and first transfer processes are sequentially carried out at predetermined time intervals, overlaying toner images in four colors into a full-color image on the intermediate transfer belt 114.

The intermediate transfer belt 114 rotates and conveys the toner image thereon to a point where the image faces a second transfer element 116. At the same time, recording paper as the transfer substrate is passed between the intermediate transfer belt 114 and the second transfer element 116 along a feeding route 117 for the recording paper in accordance with a predetermined time schedule. Applying a bias for second transfer to the second transfer element 116 induces transfer of the toner image on the intermediate transfer belt 114 to the recording paper.

The bias voltage applied to the second transfer element 116 is approximately +1000 V or more and +4000 V or less. The recording paper, carrying the toner image transferred by the second transfer element 116, is conveyed to a fixing unit. 118, where the toner image on the recording paper is fused and fixed to the recording paper. Then the recording paper is ejected from the electrophotographic apparatus, finishing printing.

If there is any toner image on the image-carrying unit 101 not transferred to the intermediate transfer belt 114 and remaining on the image-carrying unit 101, a cleaner 112 configured to clean the surface of the image-carrying unit 101 wipes this toner image off the surface of the image-carrying unit 101.

An aspect of the invention provides a developing unit that is unlikely to leave a memory on a developing roller and, therefore, unlikely to cause banding in halftone images even when held under high-temperature and high-humidity conditions for a long period of time. Some other aspects of the invention provide a process cartridge and an electrophotographic apparatus that both provide high-quality electrophotographic images.

EXAMPLES

The following describes certain aspects of the invention in more detail with reference to some specific examples and comparative examples. These examples are not intended to limit the technical scope of any aspect of the invention.

Resin Particles

Table 1 summarizes the resin particles used in the examples and comparative examples. Resin particles 1 to 6 were used for Examples 1 to 6, and resin particles 7 to 11 were used for Comparative Examples 1 to 5. The weight-average particle diameter and average circularity of the resin particles were measured using the methods described above.

TABLE 1

| Resin particles No. | Base material | Trade name | Weight-average particle diameter (μm) | Average circularity |
|---|---|---|---|---|
| 1 | Urethane polymer | — | 10.0 | 0.980 |
| 2 | Urethane polymer | — | 10.0 | 0.980 |
| 3 | Urethane polymer | — | 10.0 | 0.980 |
| 4 | Urethane polymer | — | 10.0 | 0.980 |
| 5 | Urethane polymer | — | 10.0 | 0.980 |
| 6 | Urethane polymer | — | 10.0 | 0.980 |
| 7 | Urethane polymer | "UCN5070D Clear" Dainichiseika Color & Chemicals Mfg. | 7.2 | 0.978 |
| 8 | Urethane polymer | "JB-600T" Negami Chemical Industrial | 10.2 | 0.981 |
| 9 | Urethane polymer | "CE-400T" Negami Chemical Industrial | 14.8 | 0.981 |
| 10 | Silicone polymer | "Tospearl 120" Momentive | 2.1 | 0.989 |
| 11 | Acrylic polymer | "MX-1500" Soken Chemical & Engineering | 15.1 | 0.984 |

Example 1

A 2-1, separable flask with a stirrer was charged with 800 g of water, and 32 g of METOLOSE 90SH-100 (hydroxypropyl methylcellulose, Shin-Etsu Chemical) was dissolved in the water to form a dispersion medium.

Separately, a mixture of the following materials was prepared as the raw material for resin particles: polyester polyols, 48.0 g of P-3010 and 12.0 g of F-3010; isocyanate component, 84.0 g of TPA-100 and 16.6 g of TAKENATE 500; diluent, 240.9 g of methyl ethyl ketone (MEK); catalyst, 0.003 g of dibutyltin dilaurate. The ratio by weight of polyol to isocyanate components, OH/NO %, of this raw material for resin particles was 15.0.

While the dispersion medium was stirred at 600 rpm, the raw material for resin particles was added to form a suspension. The suspension was then heated to 60° C. and allowed to react for 4 hours with continuous stirring. The suspension was then allowed to cool to room temperature and subjected to solid-liquid separation. The isolated solid was thoroughly washed with water and dried at 70° C. for 20 hours. In this way, polyurethane resin particles were obtained with an average particle diameter of 10 μm.

The toluene absorbency and Martens hardness of the obtained polyurethane resin particles were 28 g and 8.0 $N/mm^2$, respectively.

Example 2

Polyurethane resin particles were obtained in the same way as in Example 1, except for the following changes to the materials: polyester polyols, 30.5 g of F-510 and 24.4 g of LB-3000; isocyanate component, 105.0 g of TPA-100; diluent, 239.8 g of methyl ethyl ketone (MEK) (the ratio by weight of polyol to isocyanate components, OH/NCO %, was 3.0).

The toluene absorbency and Martens hardness of the obtained polyurethane resin particles were 21 g and 35.0 $N/mm^2$, respectively.

Example 3

Polyurethane resin particles were obtained in the same way as in Example 1, except for the following changes to the materials: polyester polyol, 38.0 g of F-510; isocyanate component, 121.9 g of TPA-100; diluent, 239.9 g of methyl ethyl ketone (MEK) (the ratio by weight of polyol to isocyanate components, OH/NC %, was 3.0).

The toluene absorbency and Martens hardness of the obtained polyurethane resin particles were 20 g and 49.6 $N/mm^2$, respectively.

Example 4

Polyurethane resin particles were obtained in the same way as in Example 1, except for the following changes to the materials: polyester polyols, 52.0 g of F-510 and 26.0 g of F-2010; isocyanate component, 66.1 g of TAKENATE 500 and 16.3 g of TPA-100; diluent, 240.6 g of methyl ethyl ketone (MEK) (the ratio by weight of polyol to isocyanate components, OH/NCO %, was 2.3).

The toluene absorbency and Martens hardness of the obtained polyurethane resin particles were 50 g and 50.0 $N/mm^2$, respectively.

Example 5

Polyurethane resin particles were obtained in the same way as in Example 1, except for the following changes to the materials: polyester polyols, 30.0 g of P-3010, 7.5 g of F-3010, and 24.0 g of LB-3000; isocyanate component, 10.4 g of TAKENATE 500 and 87.4 g of TPA-100; diluent, 238.9 g of methyl ethyl ketone (MEK) (the ratio by weight of polyol to isocyanate components, OH/NCO %, was 15.0).

The toluene absorbency and Martens hardness of the obtained polyurethane resin particles were 29 g and 1.1 $N/mm^2$, respectively.

Example 6

Polyurethane resin particles were obtained in the same way as in Example 1, except for the following changes to the materials: polyester polyol, 130.9 g of P-3010; isocyanate component, 1.4 g TAKENATE 500 and 27.8 g of TPA-100; diluent, 240.2 g of methyl ethyl ketone (MEK) (the ratio by weight of polyol to isocyanate components, OH/NCO %, was 2.0).

The toluene absorbency and Martens hardness of the obtained polyurethane resin particles were 50 g and 1.0 $N/mm^2$, respectively.

The manufacturers of the raw materials for resin particles used in Examples 1 to 6 are as follows.

P-3010: Kuraray
F-3010: Kuraray
TPA-100: Asahi Kasei Chemicals
TAKENATE 500: Mitsui Chemicals
F-510: Kuraray
LB-3000: Sanyo Chemical Industries
F-2010: Kuraray Production of the Developing Roller Production of Conductive Elastic Layer 1

Semiconductive composition 1 was prepared by mixing the materials listed in Table 2 at the ordinary temperature using a stirrer.

TABLE 2

| | | |
|---|---|---|
| Vinyl-terminated polysiloxane | Trade name: "DMX-V42" AZmax Co., Ltd. | 100 parts by mass |
| Hydrosilylation crosslinking agent | Trade name: "DMX-V43" AZmax Co., Ltd. | 5.4 parts by mass |
| Platinum catalyst | Trade name: "SIP6831-3" AZmax Co., Ltd. | 0.15 parts by mass |
| Carbon black | Trade name: "#970" Mitsubishi Chemical | 8.0 parts by mass |

Then an SUS 304 core metal measuring 6 mm across and 264 mm long was coated with a primer (trade name, "DY35-051"; Toray Dow Corning Silicone). After the primer was fired at a temperature of 150° C. for 30 minutes, the core metal was placed in a die. Semiconductive composition 1 was then injected into a cavity located in the die, and the die was heated at 150° C. for 15 minutes. The composition released from the die was heated at 200° C. for 2 hours to complete curing reaction. In this way, conductive elastic layer 1 was produced with a diameter of 11.5 mm.

Production of Conductive Surface-Coating Solution 1 (a Coating Solution for the Formation of a Conductive Surface Layer)

A four-neck separable flask with a stirrer, a condenser, a thermometer, and a nitrogen tube was charged with the materials listed in Table 3, and the mixture was allowed to react in a nitrogen atmosphere at 80° C. for 5 hours with stirring. The solvent was removed, yielding urethane prepolymer 1 as a compound having a carboxy group in the molecule.

TABLE 3

| | | |
|---|---|---|
| Polyol | Trade name: "PTGL1000" Hodogaya Chemical | 250 parts by mass |
| Dimethylol propionic | Aldrich | 20 parts by mass |

TABLE 3-continued

| | | |
|---|---|---|
| acid | | |
| 4'4-Diphenylmethane diisocyanate | Aldrich | 100 parts by mass |
| Methyl ethyl ketone | — | 1000 parts by mass |

Then the materials listed in Table 4 were stirred and dispersed using a ball mill. In this way, conductive surface-coating solution 1 was produced.

TABLE 4

| | | |
|---|---|---|
| Urethane prepolymer 1 | | 150 parts by mass |
| Polyol | Trade name: "NIPPOLLAN 4010" Nippon Polyurethane Industry | 100 parts by mass |
| Carbon black | Trade name: "#2700" Mitsubishi Chemical | 30 parts by mass |
| Acrylic resin particles | Trade name: "MX-1000" Soken Chemical & Engineering | 30 parts by mass |

The solids content of this surface-coating solution 1 was adjusted to 28% with methyl ethyl ketone. Conductive elastic layer 1, molded as described above, was then dipped into the coating solution. The coating was then heated in an oven at a temperature of 80° C. for 15 minutes for drying and then at 110° C. for 4 hours for curing. In this way, a developing roller was obtained. The thickness of the surface layer was 10.2 μm.

Evaluation, for Surface Potential Unevenness and Banding

The obtained developing roller was uniformly coated with 100 mg of the resin particles over its entire length. Then from a cyan toner process cartridge for a color laser printer (trade name, HP LaserJet Pro 400M451dn; HP) its developing roller was removed, and the toner regulating member in the process cartridge was cleaned with a blow of air. The developing roller coated with resin particles was then installed in this process cartridge. In this way, a process cartridge was produced having a developing unit in which there were resin particles at the point of contact between a developing roller and a toner regulating member.

This process cartridge was left under the conditions of 40° C. and 95% RH for 30 days, and then moved to the conditions of 23° C. and 50% RH and allowed to stand there for 24 hours. After the removal of a seal separating a developing chamber and a toner container in the developing unit, the process cartridge was installed in the laser printer. The laser printer was then operated to continuously print a full-size cyan halftone image on 100 sheets of A4 recording paper (for CLC (Color Laser Copier manufactured by Canon; grammage, 81.4 g/m$^2$) under the conditions of 15° C. and 10% RH.

Then the developing roller was removed from the process cartridge, and the surface potential was measured using a surface electrometer (QEA DRA-2000L) in the area of the roller where it was in contact with the toner regulating member before image formation (contact area) and in the area where it was not (noncontact area). The difference between the measured surface potential between the contact and noncontact areas was defined as the degree of surface potential unevenness. Furthermore, the 100 sheets of halftone images were visually inspected for banding and graded in accordance with the criteria below.

TABLE 5

| Rank | Evaluation criteria |
|---|---|
| A | No banding in any halftone image |
| B | Minor banding in the first halftone image, but no banding in the second and later images |
| C | Banding obvious in the first to ninth halftone images, but minor in the 10th to 19th and unnoticeable in the 20th and later images |
| D | Banding obvious even in the 100th halftone image |

TABLE 6

| | Resin particles No. | Toluene absorbency per 40 g of resin particles (g) | Martens hardness (N/mm$^2$) | Surface potential unevenness Δ (V) | Banding rank |
|---|---|---|---|---|---|
| Example 1 | 1 | 28 | 8.0 | 0 | A |
| Example 2 | 2 | 21 | 35.0 | 0 | A |
| Example 3 | 3 | 20 | 49.6 | 0 | A |
| Example 4 | 4 | 50 | 50.0 | 0 | A |
| Example 5 | 5 | 29 | 1.1 | 0 | A |
| Example 6 | 6 | 50 | 1.0 | 0 | A |
| Comparative Example 1 | 7 | 90 | 2.8 | 6.0 | D |
| Comparative Example 2 | 8 | 170 | 0.5 | 10.0 | D |
| Comparative Example 3 | 9 | 55 | 11.0 | 4.0 | C |
| Comparative Example 4 | 10 | 25 | 52.0 | 1.0 | B |
| Comparative Example 5 | 11 | 36 | 94.0 | 1.0 | B |

Table 6 summarizes toluene absorbency, Martens hardness, and the results of the evaluation of surface potential unevenness and banding for each composition of resin particles.

In Examples 1 to 6, there were resin particles according to an embodiment of the invention between the developing roller and the toner regulating member. This prevented changes in electrical resistance on the surface of the developing roller and reduced surface potential unevenness and banding images.

This was achieved presumably through the following effects.

That is, the resin particles had a Martens hardness that fell within a particular range, and this limited the physical stress the resin particles put on the developing roller. Furthermore, the resin particles had a toluene absorbency that fell within a particular range, and this restricted the adsorption of low-molecular-weight components of the developing roller by the resin particles up to the surface of the roller.

In Examples 1 to 6, the characteristics of the resin particles disposed at the point of contact between the developing roller and the toner regulating member met requirements according to a certain aspect of the invention. As a result, the technical advantages of a certain aspect of the invention were obtained.

For the developing units according to Comparative Examples 1 to 3, the resin particles interposed between the developing roller and the toner regulating member had a high toluene absorbency. This caused low-molecular-weight components of the developing roller to be adsorbed by the resin particles, leading to uneven distribution of surface potential associated with nonuniform electrical resistance. As a result, banding occurred in the halftone images.

For the developing units according to Comparative Examples 4 and 5, the resin particles interposed between the developing roller and the toner regulating member had too high a Martens hardness. This made the electrical resistance on the developing roller nonuniform, seemingly because of physical stress on the roller. The resulting uneven distribution of surface resistance led to banding in the halftone images.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application. No. 2014-262500 filed. Dec. 25, 2014, which is hereby incorporated by reference herein in its entirety.

What is claimed is:

1. A developing unit comprising:

a developing chamber provided with a developing roller and a toner regulating member, the developing roller configured to hold toner on a surface thereof and deliver the toner to a developing region, the toner regulating member configured to regulate an amount of the toner held on the surface of the developing roller; and a toner container containing the toner, the developing roller and the toner regulating member being in contact with each other at a point of contact, with resin particles therebetween, the resin particles having:

a toluene absorbency of 20 g or more and 50 g or less per 40 g of the resin particles; and a Martens hardness of 1.0 $N/mm^2$ or more and 50.0 $N/mm^2$ or less.

2. The developing unit according to claim 1, further comprising a passage through which the developing chamber communicates with the toner container, the passage partitioned with a removable seal configured to prevent the toner in the toner container from flowing into the developing chamber.

3. The developing unit according to claim 1, wherein the resin particles contain a urethane polymer.

4. The developing unit according to claim 1, wherein the resin particles have an average circularity of 0.960 or more.

5. The developing unit according to claim 1, wherein the resin particles have a weight-average particle diameter of 1 μm or more and 50 μm or less.

6. The developing unit according to claim 1, wherein the developing roller has a surface layer containing a urethane polymer.

7. A process cartridge configured to be detachably attached to a main body of an electrophotographic apparatus, the process cartridge comprising:

an image carrier configured to carry an electrostatic latent image; and a developing unit configured to develop the electrostatic latent image with toner and to form a toner image, the developing unit being a developing unit according to claim 1.

8. An electrophotographic apparatus comprising:

an image carrier configured to carry an electrostatic latent image;

a charging unit configured to charge the image carrier;

an exposure unit configured to produce an electrostatic latent image on the charged image carrier;

a developing unit configured to develop the electrostatic latent image with toner and to form a toner image;

a transfer unit configured to transfer the toner image to a transfer substrate; and a fixing unit configured to fix the toner image transferred to the transfer substrate, the developing unit being a developing unit according to claim 1.

9. The developing unit according to claim 1, wherein the resin particles are applied to allow the developing roller and the toner regulating member to be uniformly coated by:

1) applying the resin particles to the entire surface of the developing roller and installing the developing roller in the developing unit to which the toner regulating member has already been attached, 2) applying the resin particles to an area of the toner regulating member contacting the developing roller and installing the toner regulating member and the developing roller in the developing unit, or 3) applying the resin particles to the entire surface of the toner feeder and installing the toner feeder in the developing unit and turning the developing roller and the toner feeder to deliver the resin particles to the point of contact between the developing roller and the toner regulating member.

* * * * *